US005678905A

United States Patent [19]

Kelley

[11] Patent Number: 5,678,905

[45] Date of Patent: Oct. 21, 1997

[54] CONCEALED DESK

[75] Inventor: James O. Kelley, Spring Lake, Mich.

[73] Assignee: Sligh Furniture Co., Holland, Mich.

[21] Appl. No.: 428,530

[22] Filed: Apr. 25, 1995

Related U.S. Application Data

[63] Continuation-in-part of Ser. No. 7,733, May 3, 1993, Pat. No. Des. 357,599, Ser. No. 37,658, Apr. 17, 1995, Pat. No. Des. 376,491, and Ser. No. 37,654, Apr. 17, 1995, Pat. No. Des. 376,496.

[51] Int. Cl.[6] ..... A47B 17/00

[52] U.S. Cl. ..... 312/196; 312/258; 312/262; 312/291; 312/326

[58] Field of Search ..... 140/210, 213; 312/194, 196, 223.3, 262, 258, 326, 291

[56] References Cited

U.S. PATENT DOCUMENTS

| | | | |
|---|---|---|---|
| D. 83,703 | 3/1931 | Simons et al. . | |
| 184,375 | 11/1876 | Hansen | 160/210 |
| 271,061 | 1/1883 | Hafgar | 312/258 X |
| D. 281,382 | 11/1985 | Byrne et al. . | |
| D. 284,051 | 6/1986 | Adkinson | D6/438 |
| D. 284,242 | 6/1986 | Sackett et al. . | |
| D. 289,715 | 5/1987 | Kirch . | |
| D. 291,162 | 8/1987 | Kwiecinski . | |
| D. 300,486 | 4/1989 | Kaplan et al. . | |
| 654,922 | 7/1900 | Schipkowsky | 312/298 X |
| 1,638,863 | 8/1927 | Mabe | 312/258 X |
| 1,948,703 | 2/1934 | Fanarjian | 312/196 |
| 2,746,825 | 5/1956 | Lee | 312/194 X |
| 3,078,133 | 2/1963 | Schauer | 312/223 |
| 3,400,749 | 9/1968 | Smith | 160/213 |
| 3,862,785 | 1/1975 | Scheerhorn et al. | 312/196 X |
| 4,755,009 | 7/1988 | Price et al. | 312/194 |
| 4,766,422 | 8/1988 | Wolters et al. | 312/223.3 X |
| 5,121,974 | 6/1992 | Monson | 312/194 |

*Primary Examiner*—Peter M. Cuomo
*Assistant Examiner*—Stephen Vu

[57] ABSTRACT

A concealed desk comprises a desktop with supporting side panels and a kneehole opening and storage compartments under the desktop. The front of the desk is completely enclosable by folding doors mounted on front side edges of the desk side panels. When the doors are opened, the doors fold against the side panels of the desk and do not obstruct either the appearance or the use of the desk. The door facades are those of conventional doors and conceal the presence of a kneehole opening or storage compartments in the desk opening inside the doors. The desktop surface of the desk is concealed by an upper storage unit mounted on the desktop or comprising an extension of the desk above the desktop work surface. Doors enclose the top portion of the desk unit in the same manner as the doors on the lower portion, giving the furniture the appearance of a cabinet or a secretary. Full length doors can enclose both the upper and lower portions of the desk to give the furniture the appearance of an armoir.

5 Claims, 12 Drawing Sheets

CONCEALED DESK

CROSS-REFERENCE TO RELATED APPLICATIONS

This is a continuation-in-part of applicant's patent applications Ser. No. 29/007,733, filed May 3, 1993 now U.S. Pat. No. D 357,599, issued Apr. 25, 1995; Ser. No. 037,658, now U.S. Pat. No. Des 376,491 filed Apr. 17, 1995, and entitled COMPUTER SECRETARY; and Ser. No. 29/037,654, now U.S. Pat. No. 376,496, filed Apr. 17, 1995, and entitled COMPUTER WORKPLACE.

FIELD OF THE INVENTION

The present invention relates to a desk wherein the front of the desk is completely enclosed by doors that conceal the presence of a desk and wherein the doors fold unobtrusively against the side of the desk when opened.

BACKGROUND OF THE INVENTION

The presence of an office in the home is an increasing trend. A home office may be used for household finances or for doing business work at home. An increasingly popular use is for the operation of a computer in the home. Home offices typically include a desk and file and drawer storage.

With a premium on space in most homes and apartments, it is not always possible to dedicate a room solely to a home office, and even where this is the case, it is desirable to give the home office a more homey appearance than conventional office furniture provides. For this reason, it is desirable to incorporate a desk and storage compartments and computer hardware into a furniture unit that can be closed up to conceal the fact that the unit is actually a desk and to conceal the computer hardware.

A object of the present invention is to provide a desk and accompanying storage compartments that are completely enclosable by doors on the front side thereof so as to create the impression of a cabinet, secretary or armoir when closed, but which are fully openable with doors that fold neatly out of the way to provide a fully functioning desk therein.

SUMMARY OF THE INVENTION

In accordance with the present invention, a concealed desk comprises a desktop having side panels at side edges thereof that define a desk opening under the desktop. The desk opening includes a kneehole opening for sitting at the desk on a chair and one or more columns of storage or file compartments at one or more sides of the desk openings. The desk opening is completely enclosable by folding doors mounted on front side edges of the desk side panels. When the doors are closed, the desk opening is completely covered by the doors. When the doors are opened, they fold against the side panels of the desk and do not obstruct either the appearance or the use of the desk. The door facades are those of conventional doors and belie the presence of a kneehole opening or storage compartments and the desk opening inside the doors. The desktop surface of the desk is concealed by an upper portion of the furniture unit in the form of a storage unit or hutch that is mounted on the desktop or comprises an extension of the desk above the desktop work surface. The upper portion includes storage compartments that are accessible from the front of the desk and include a recess for a desktop writing surface or for a computer monitor. Doors enclose the top portion of the desk unit in the same manner as the doors on the lower portion, giving the furniture the appearance of a cabinet or a secretary. Where the peripheral dimensions of the upper portion are the same as the lower portion, full length doors can enclose both the upper and lower portion, giving the furniture the appearance of an armoir. In all cases, the doors fold against the side panels of the desk when opened so that the door enclosures for the desk are concealed when the doors are opened.

These and other features of the present invention are described in detail below and shown in the appended drawings.

DETAILED DESCRIPTION OF PREFERRED EMBODIMENTS

Figure 1:
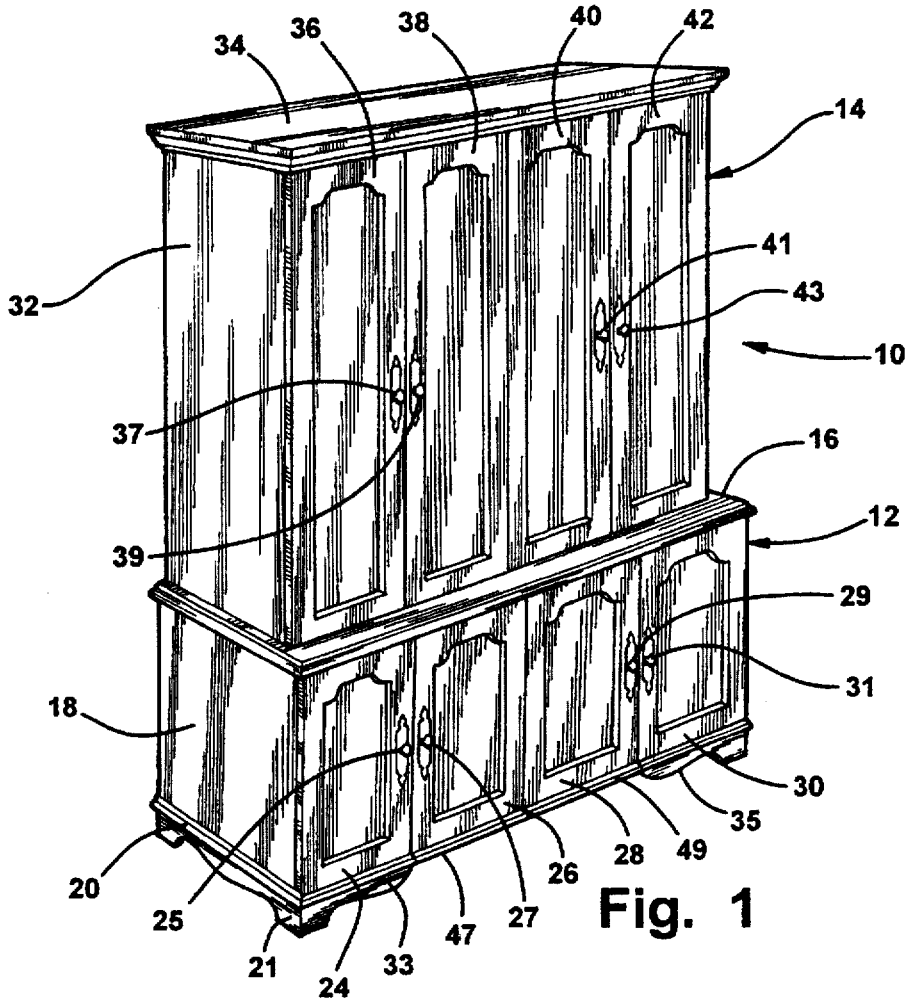
FIG. 1 is a perspective view of the computer workstation design with accompanying doors in the closed position showing the top, front, and left side thereof.

Referring to the drawings, a first embodiment of the invention, referred to as a computer cabinet 10, is shown completely in FIGS. 1–12. Computer cabinet 10 comprises a lower desk unit 12 and an upper storage unit or hutch 14 mounted on desk unit 12. As shown in the drawings, the peripheral footprint of storage unit 14 is smaller than the area of top 16 of the desk.

Desk 12 comprises side panels 18 on each side edge of desktop 16. The side panels extend downwardly to a base molding 20 and feet 21. The desk unit has a back panel 22 that extends across the back of the desk below desktop 16. The front of the desk is completely enclosed by four doors 24, 26, 28, and 30. The doors are shown in the closed position in FIG. 1. The facade of the doors suggest that there are four ordinary doors openable by handles 25, 27, 29, and 31 and would appear to cover storage compartments on the left and right sides of the desk. Lower portions 33 and 35 of the doors 24 and 30 appears to be fixed position feet and lower cross panels, while lower portions 47 and 49 of doors 26 and 28 appear to be a part of the edge molding 20 extending around the outer edge of a bottom floor of the cabinet and across the width of the cabinet under the doors. These lower components actually are components of the door panels and pivot open with the door panels.

The upper storage unit 14 has the same appearance as the desk, with the exception that the upper storage unit is taller than the desk. Upper storage unit 14 includes side panels 32 that enclose the sides of the desk and a top 34 that covers the top. Doors 36, 38, 40, and 42 enclose the front of storage unit 14, with handles 37 and 39 being positioned adjacent where the doors 36 and 38 abut each other. Handles 41 and 43 are positioned on doors 40 and 42 adjacent an abutting edge of these doors. The facades of these doors and the door hardware thus Give the impression that doors 36 and 42 open outwardly to the sides of the cabinet, while doors 38 and 40 are mounted at the center of the cabinet and pivot inwardly.

Figure 3:
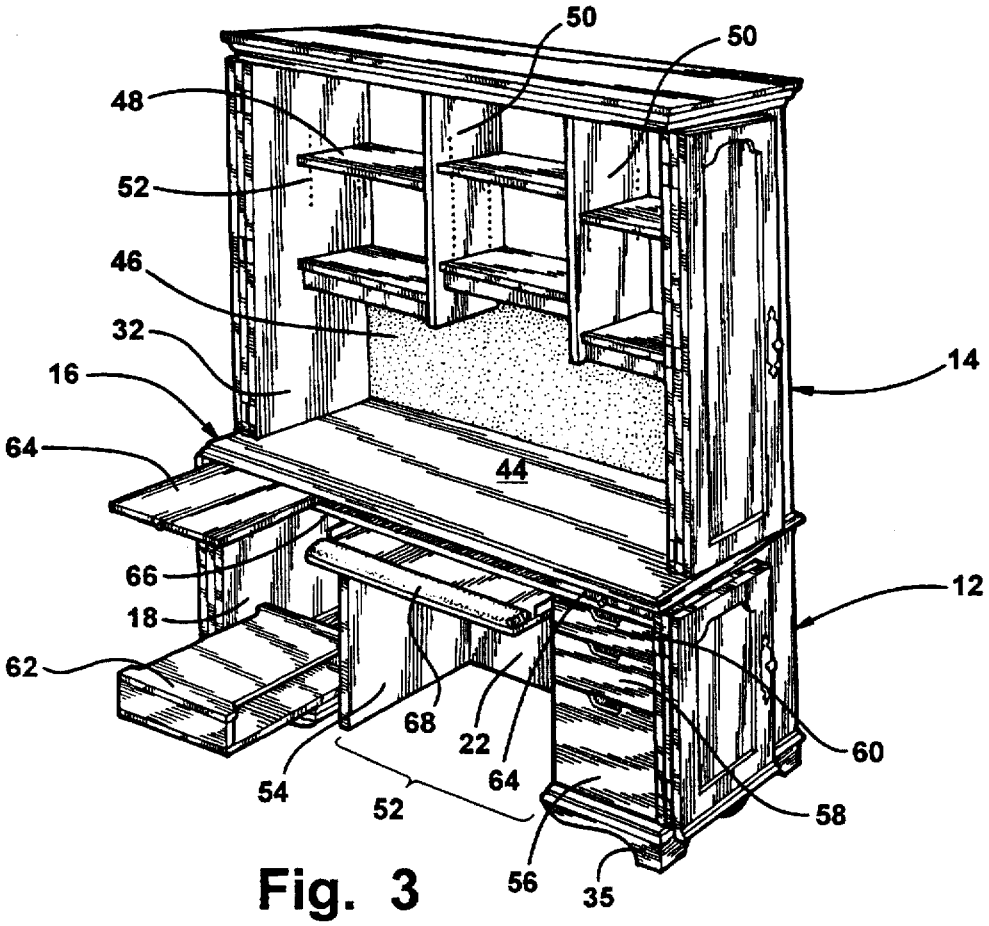
FIG. 3 is a perspective view showing the top, front, and right thereof with accompanying doors open.
Figure 4:
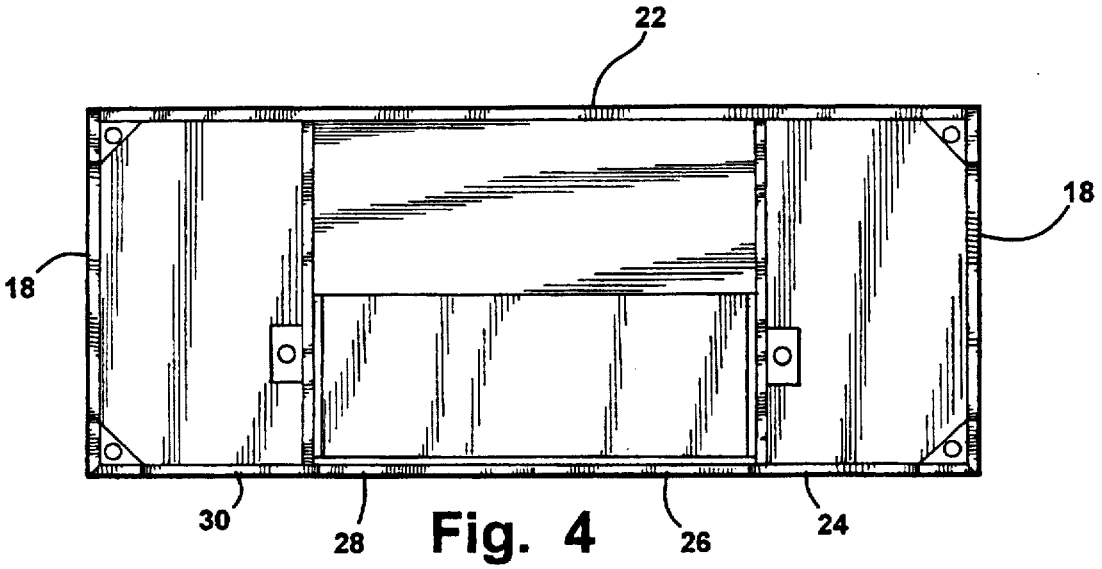
FIG. 4 is a bottom view thereof with accompanying doors closed.
Figure 5:
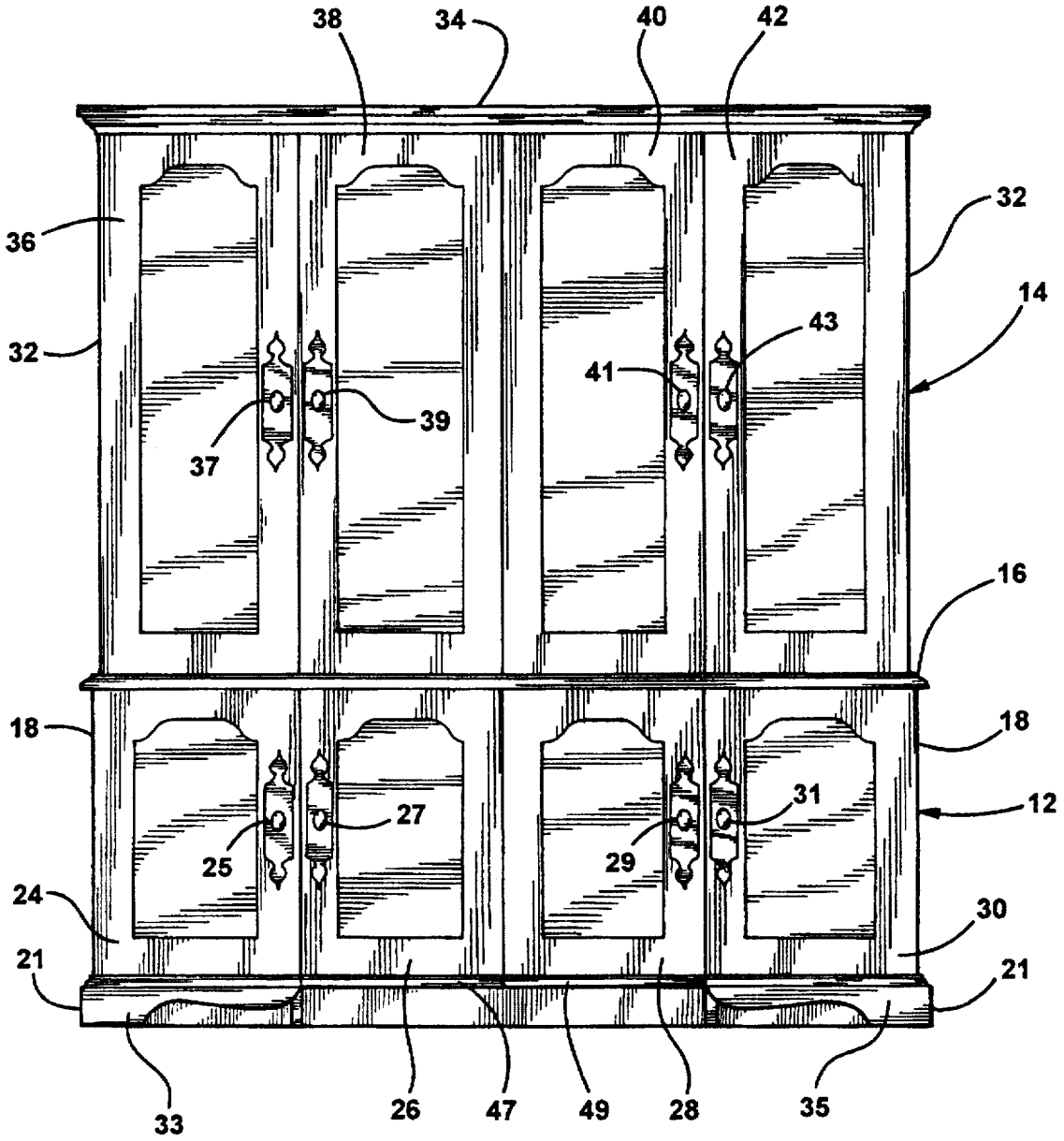
FIG. 5 is a front elevational view thereof with accompanying doors closed.
Figure 6:
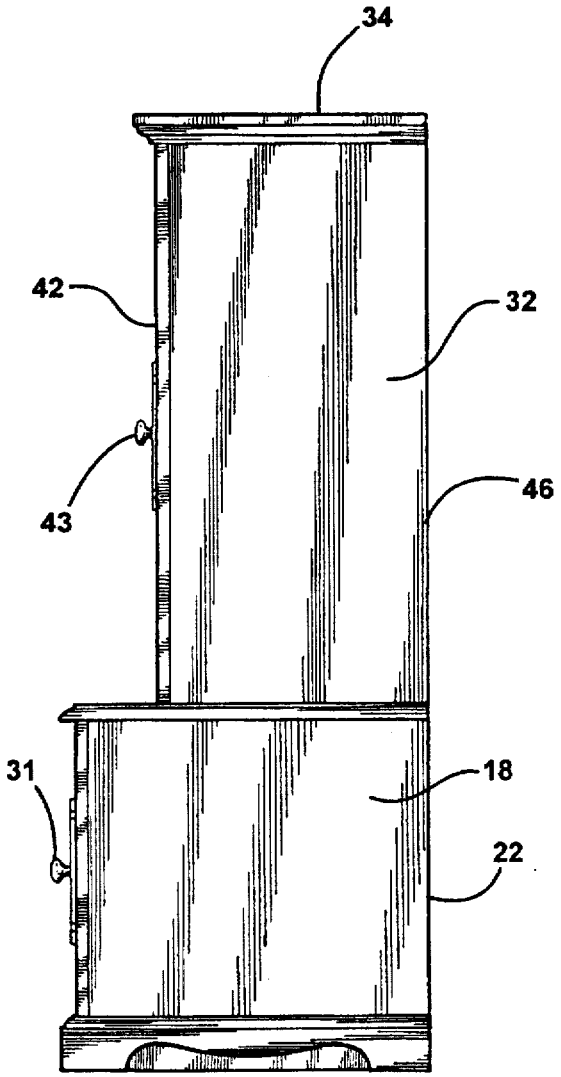
FIG. 6 is a right side elevational view thereof with accompanying doors closed.
Figure 7:
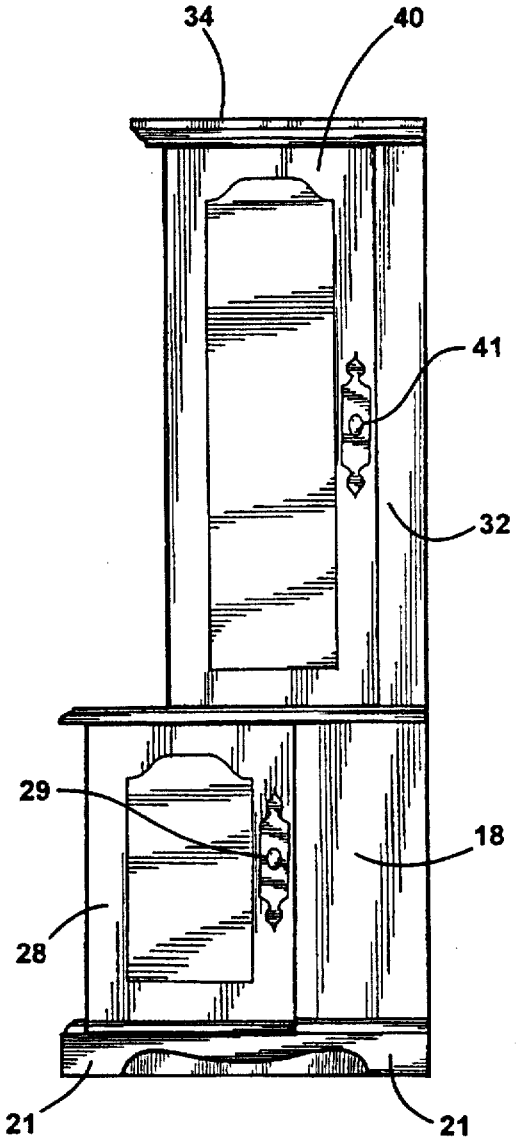
FIG. 7 is a right side elevational view thereof with accompanying doors open.
Figure 8:
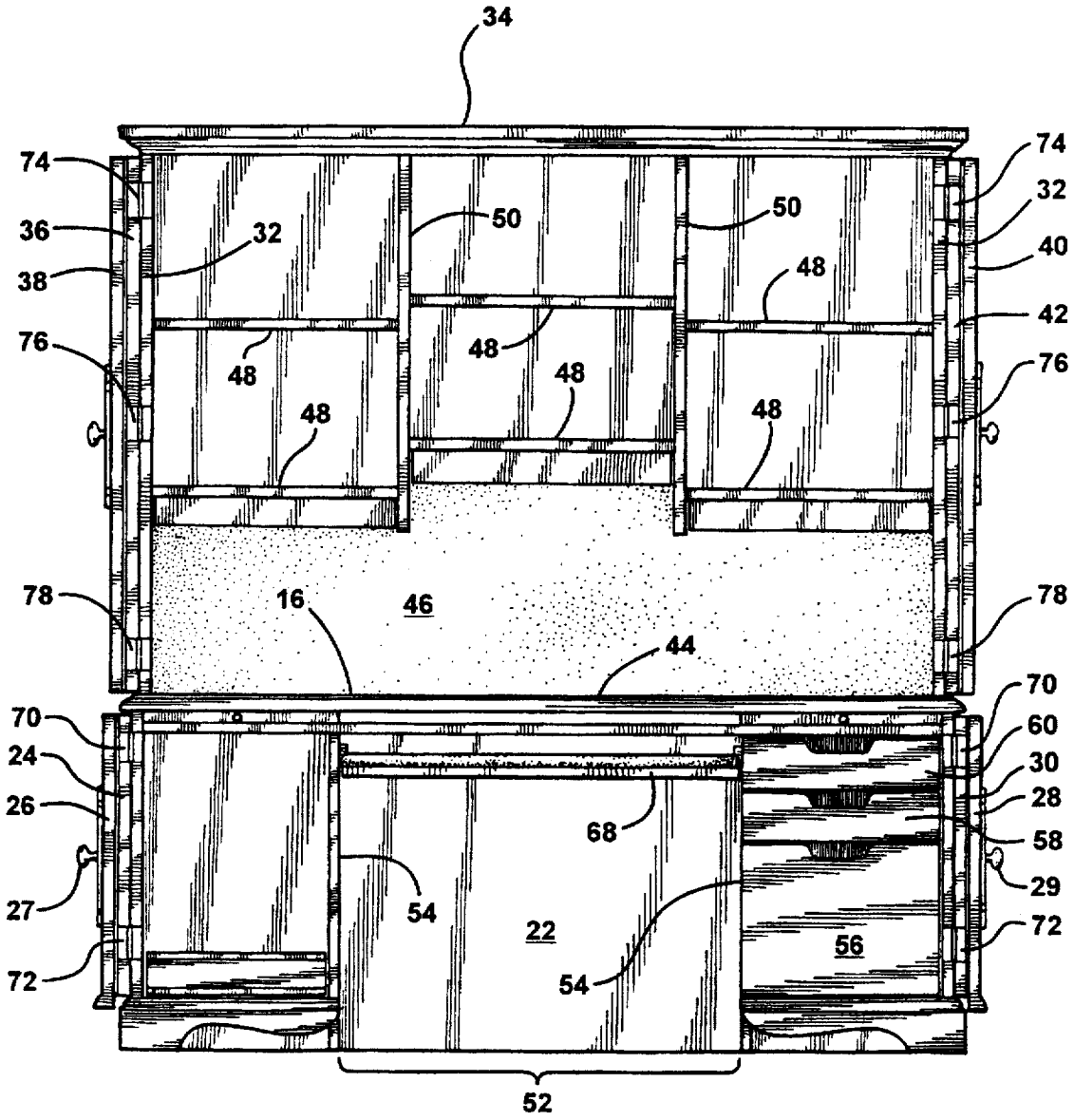
FIG. 8 is a front elevational view thereof with accompanying doors open.
Figure 9:
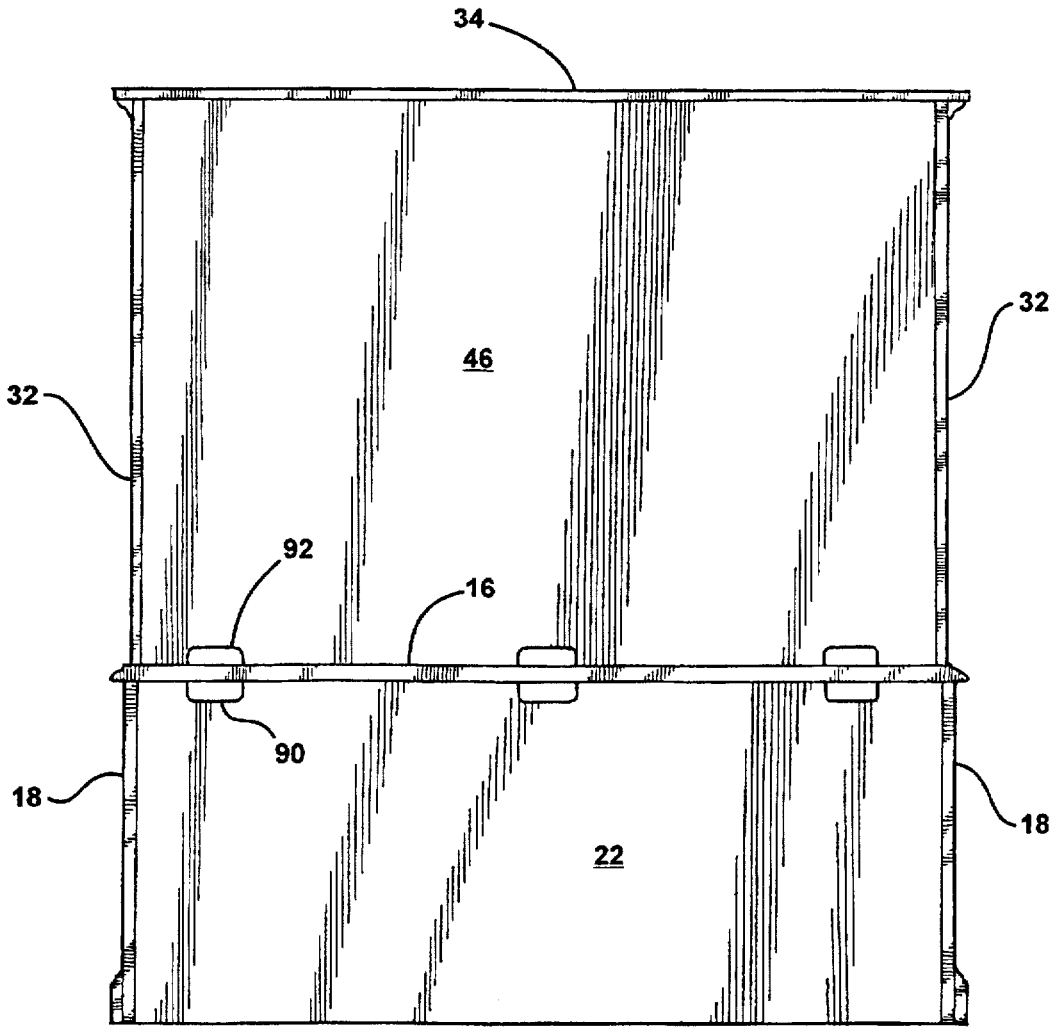
FIG. 9 is a rear elevational view thereof with accompanying doors closed.
Figure 10:
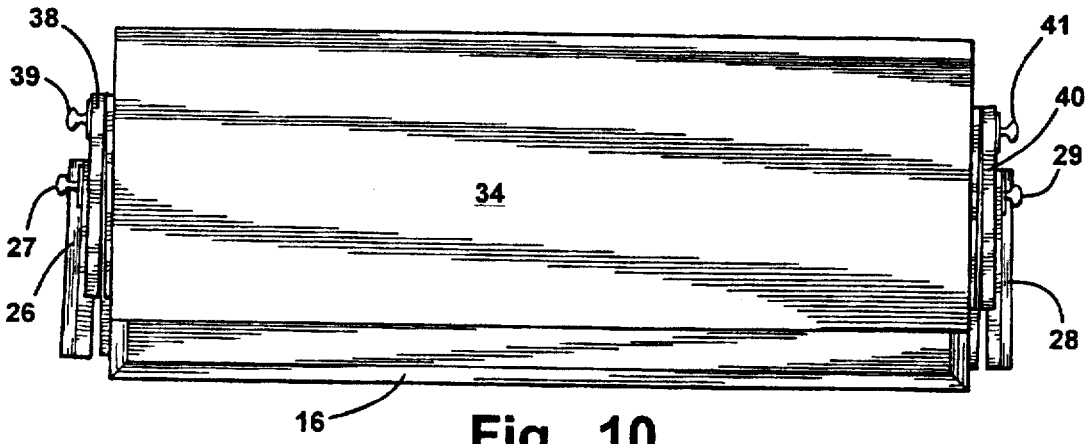
FIG. 10 is a plan view thereof with accompanying doors open.
Figure 11:
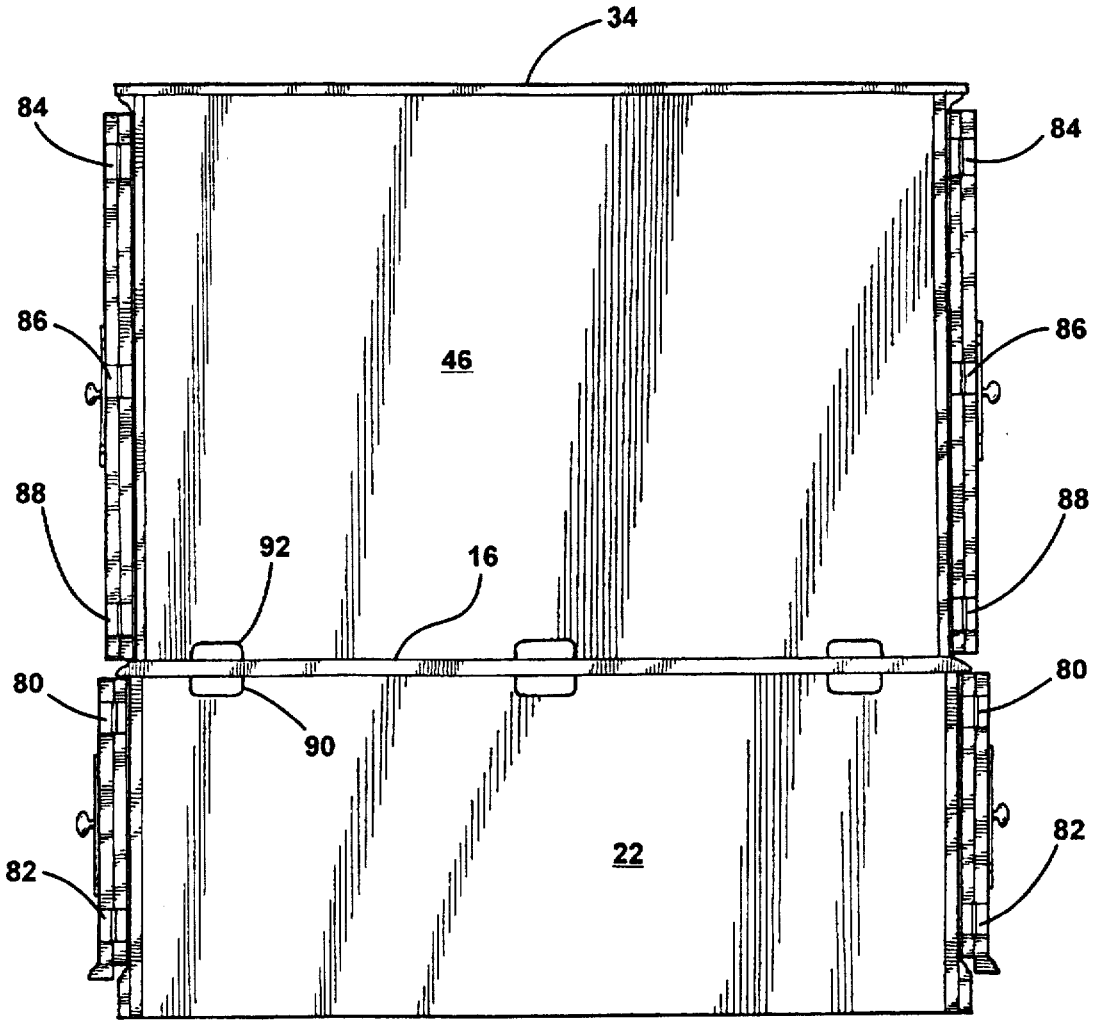
FIG. 11 is a rear elevational view thereof with accompanying doors open.
Figure 12:
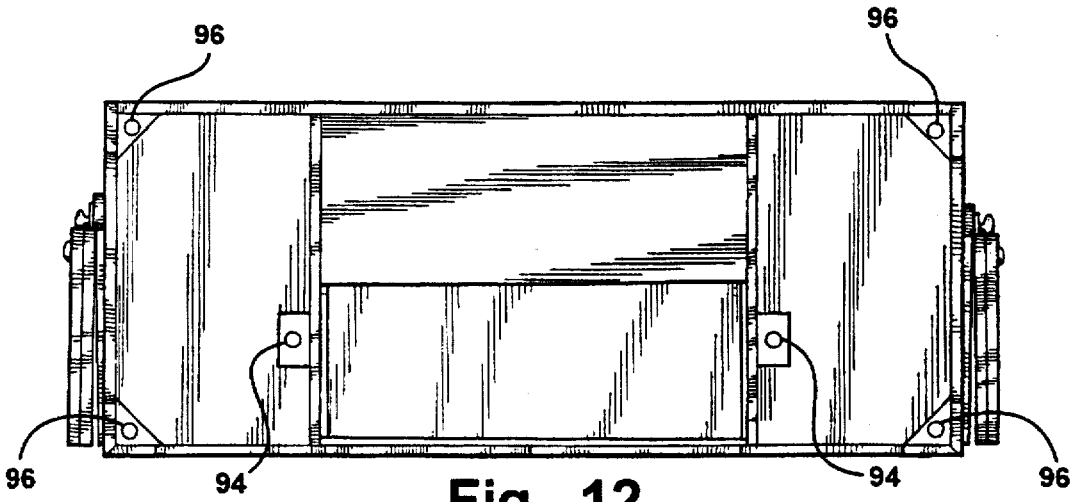
FIG. 12 is a bottom view thereof with accompanying doors open.

As shown in FIGS. 3 and 8, the interior of cabinet 10 does not house conventional storage compartments that might be present in a conventional cabinet. Rather, the interior houses a fully functional desk and storage units, in this case a computer desk. The desk has a writing surface 44 (which can also house a computer monitor) that extends the full width of the desk surface between side panels 32 of the upper storage unit and the full depth of the desk between the front edge of the writing surface to a back panel 46 of the upper storage unit. The back panel can be formed of cork or other material that will serve as a tack board. Shelves 48 are positioned between the side panels and a pair of intermediate vertical support panels 50 so as to create three columns of shelves in the interior of the upper storage compartment. The height of the shelves can be adjusted by means of spaced vertical openings 52 in the support panels, using conventional mounting hardware.

The desk unit 121 includes a kneehole space 52 centered in the desk opening beneath the desktop 16 and between the side panels 18. Inner vertical panels 54 at each side of the kneehole space provide inner support for a file cabinet 56 and box drawers 58 and 60 on the right hand side of the desk (FIG. 3) and provide support for a slide out printer drawer 62 on the left hand side of the desk (FIG. 3). Slide out work surfaces 64 are mounted at the left and right hand sides of the desk between a panel 66 and the underside of desktop 16. An extendable keyboard tray 68 is mounted on the underside of panel 66 in the kneehole opening area of the desk.

The manner in which the doors open is shown in FIGS. 3, 8, 10, 11, and 12. Outer doors 24 and 30 of the desk unit are pivotally hinged to front edges of side panels 18 by means of upper and lower hinges 70 and 72. Outer doors 36 and 42 of the upper storage unit are hinged on front edges of side panels 32 by means of hinges 74, 76, and 78 at the upper end, middle, and lower end of the doors. The outer door panels 24 and 30 of the desk unit and the outer door panels 36 and 42 of the upper storage unit fold against the side panels 18 and 32 of the desk unit and upper storage unit, in the manner shown in FIGS. 3, 8, and 10–12.

At the same time, inner door panels 26 and 28 of the desk unit are pivotally connected to outer doors 24 and 30, respectively, by hinges 80 and 82 (FIG. 11) so that inner surfaces of doors 26 and 28 pivot into abutment with inner surfaces of doors 24 and 30. Thus, the doors fold inconspicuously out of the way against the side panels of the desk unit when the desk is being used as a desk.

In a similar manner, inner doors 38 and 40 are pivotally attached to outer doors 36 and 42 of the upper storage unit by means of hinges 84, 86, and 88 at the upper end, middle, and lower end of the upper storage unit doors. These doors similarly lie against the side panels of the upper storage unit when the desk is used as a desk.

The back panels 22 and 46 of the desk and upper storage units respectively, can include openings 90 and 92 therein spaced across the back panels in order to provide wiring access through the back panels of the desk. Wiring openings 94 also can be provided in the bottom of the desk for wiring access through the bottoms of the drawer units. Similar openings 96 can be provided in the corners of the bottom of the desk unit.

Another embodiment 100 of the present invention is shown in FIGS. 13–17. Desk and storage unit 100 has the appearance of a "secretary" and is somewhat more narrow than the embodiment of FIG. 1. Unit 100 comprises a lower desk unit 102 and an upper hutch 104 that rests on top 106 of the desk unit. Hutch 104 is substantially the same size as the desk unit, with a peripheral molding on the edge of top 106 extending outwardly beyond the outer periphery of the hutch and desk units.

Figure 13:
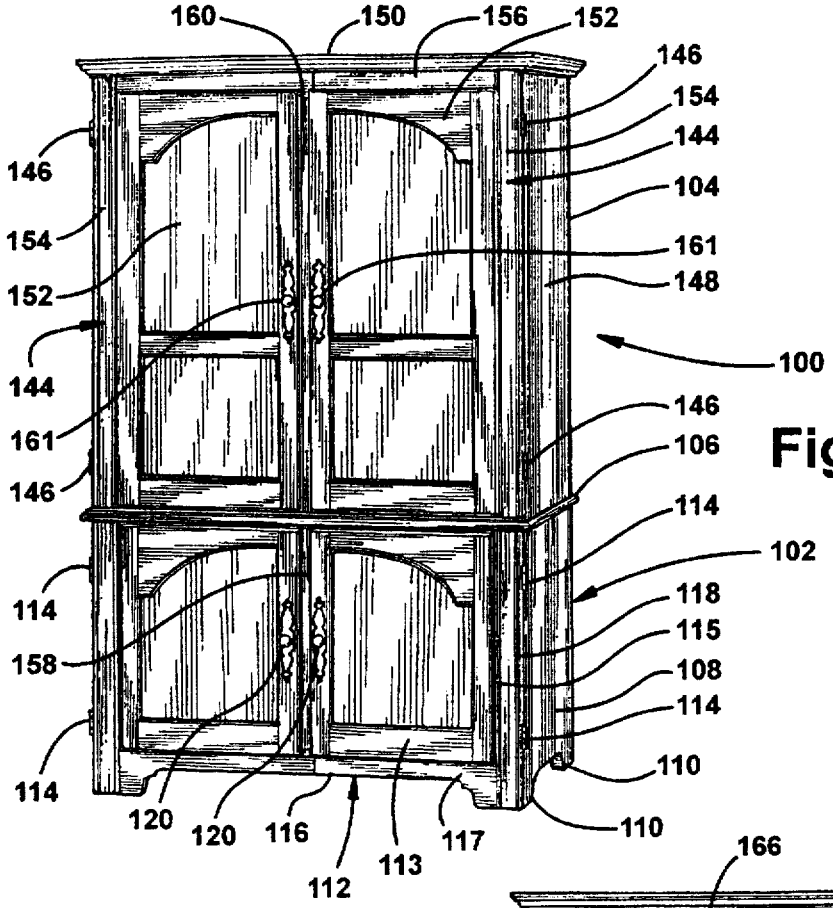
FIG. 13 is a perspective view of a second embodiment of the invention, comprising a computer secretary desk, with doors on separable top and bottom sections thereof closed.

As shown in FIG. 13, desk unit 102 comprises side panels 108 that extend downwardly to corner feet 110 at the front and rear corners of the side panels. Doors 112 are hinged on hinges 114 on the front edges of side panels 108. Doors 112 have the appearance of door panels 113 having side edges 115 spaced inwardly from a vertical side panel 118 at the side edge of the secretary and bottom edges 117 spaced above a lower transverse panel 116 that is fixed in place and runs the entire width of the cabinet. It also appears that the doors latch to a fixed position center strip 158. Thus, it would appear from the facade of lower door panels 112 that the doors open into a conventional storage cabinet.

Figure 2:
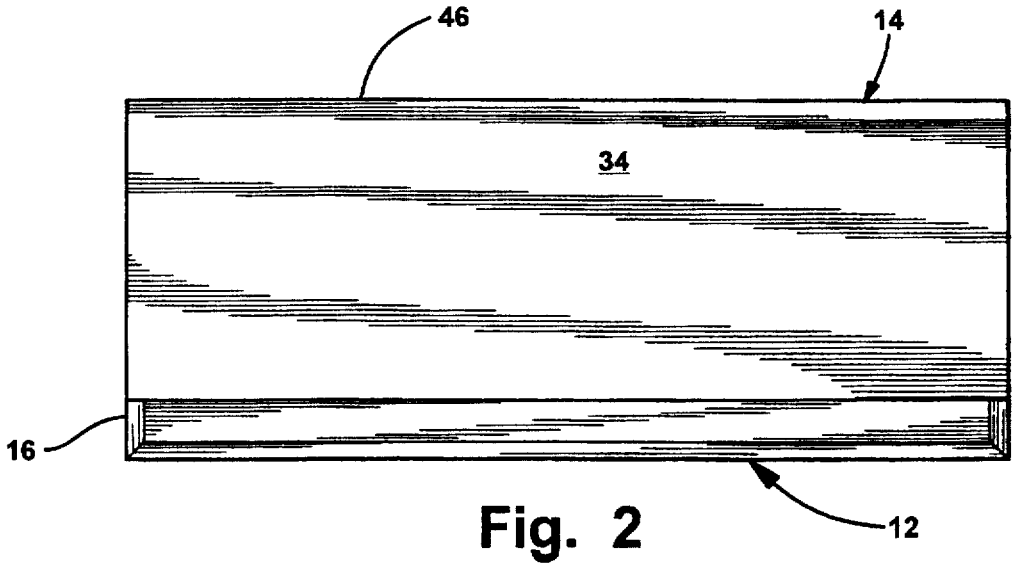
FIG. 2 is a plan view thereof with accompanying doors closed.
Figure 14:
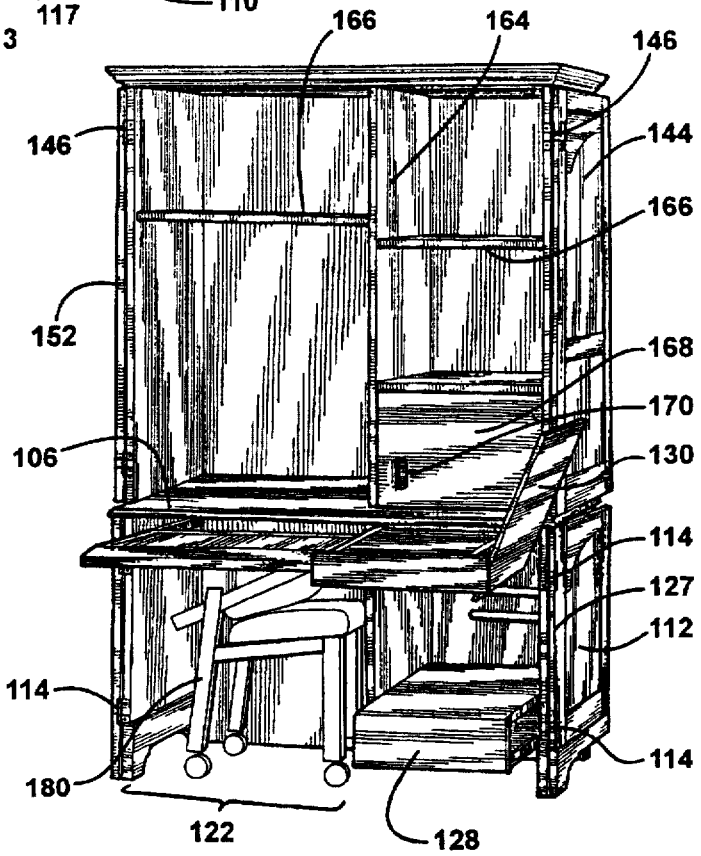
FIG. 14 is a right front perspective view thereof, with the doors on the top and bottom of the desk being folded open against the sides of the desk and showing the interior of the desk, with a work surface drawer, keyboard drawer and printer drawer shown in an extended position and with a top of the work surface drawer being pivoted upwardly to an inclined position where the top serves as a work stand.

Notwithstanding this appearance, as shown in FIG. 14, door panels 113, lower panels 116, vertical side panels 118, and center strip 158 all form a part of the doors and open with the doors by means of door handle 120. Thus, notwithstanding the appearance, the entire door opens at the bottom of the desk, revealing, as shown in FIG. 2, a kneehole opening 122 on the left side of the desk opening below desktop 106.

Figure 15:
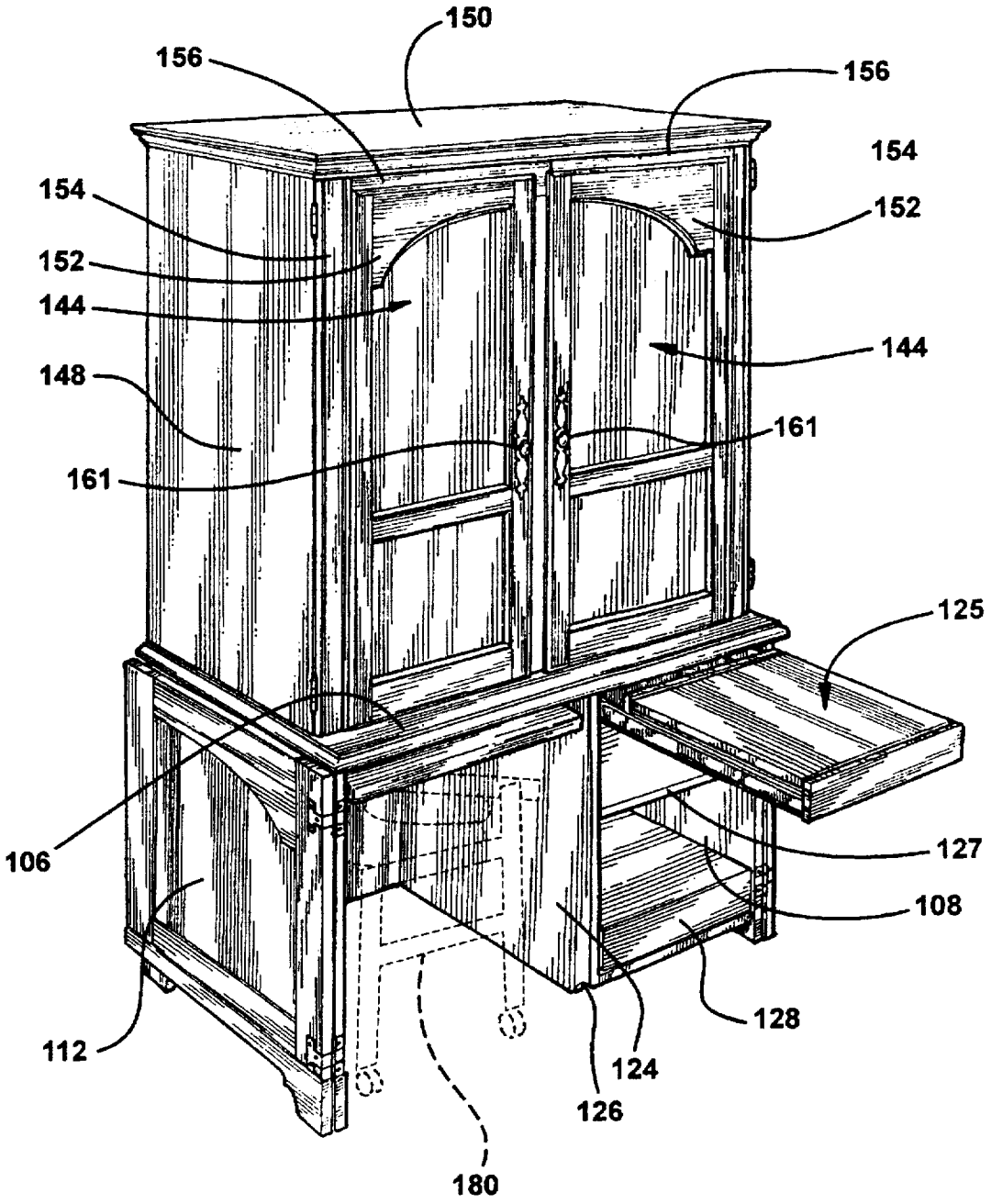
FIG. 15 is a left front perspective view thereof showing the desk with the lower doors open and work surface drawer extended, with the work surface top being folded down on the work surface.

As shown in FIGS. 14 and 15, an interior vertical support panel 124 extends downwardly from the underside of work surface or desktop 106 at a position adjacent the side of the kneehole opening. A front lower edge 126 of panel 124 is recessed so as to make panel 124 less visible from the front of the cabinet when doors 112 are closed, with simulated cross member 116 being raised above the bottom of the cabinet.

Figure 16:
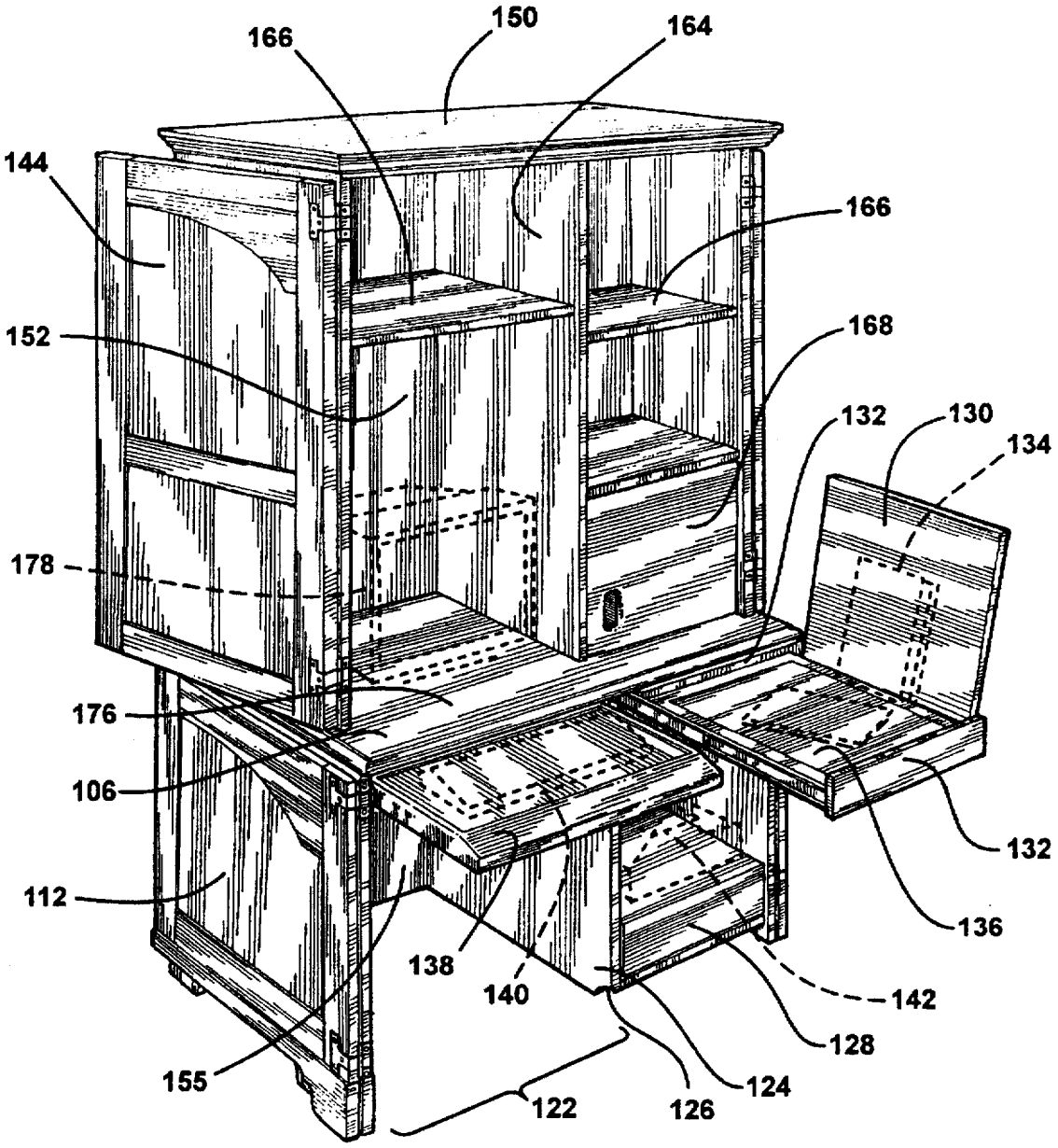
FIG. 16 is a left front perspective view thereof showing the upper and lower doors open and the work surface drawer and keyboard drawer extended and with the work surface top being raised so as to serve as a work stand.
Figure 17:
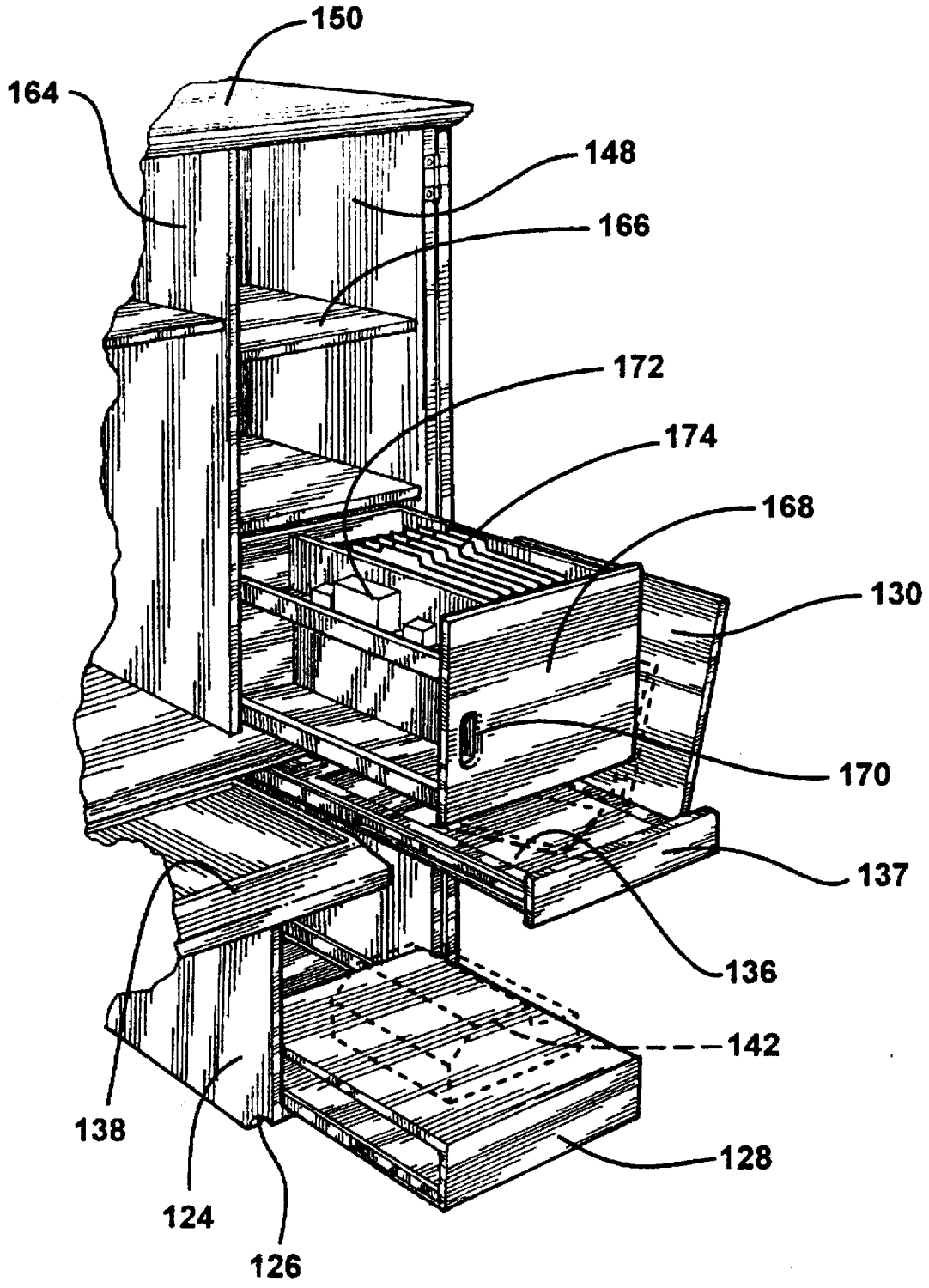
FIG. 17 is a partial left front perspective view of the interior of the desk, with the file drawer, work surface drawer, and printer drawer extended.

Mounted between panel 124 and outer panel 108 are a slide out work unit 125, a fixed shelf 127, and a slide out printer drawer 128. As shown in FIGS. 14, 16, and 17, slide out work unit 125 includes a pivoting top 130 pivotally mounted between two side panels 132 at a rear edge of the slide out work unit. Top 130 pivots upwardly and then rests at an inclined angle (as shown best in FIG. 14) where it serves as a work stand for typing copy or a book 134. When top 130 is pivoted upwardly, a work surface 136 positioned under the top is revealed. This is used for writing or the like. A slide out keyboard drawer 138 is positioned on the underside of desktop 106 at the top of kneehole opening 122. A computer keyboard 140 can be mounted in tray 138. A printer 142 can be mounted on slide out printer tray 128.

The upper storage unit or hutch 104 has an appearance similar to lower desk unit 102 and includes a pair of doors 144 mounted on hinges 146 at the front edges of side panels 148. A top 150 with an edge molding is mounted on the top of the hutch. Both the hutch and the desk have back panels 152 and 155 respectively which enclose the back surface of the unit. Like the desk unit, hutch doors 144 have the appearance of door panels 152 pivotally mounted on a fixed side frame 154 and below a face panel 156 that extends across the top of the front of the hutch. As shown in FIG. 14, however, panels 152, 154, and 156 are all part of the same door panel and open up the complete interior of the unit when the doors are pivoted open. The doors in the upper storage unit also appear to have a center strip 160, which creates the impression of a fixed center frame to which the doors are latched. In fact, the center strip comprises part of one of the doors and pivots out of the way to completely open the interior of both the desk and the hutch when the doors are opened by handles 161.

As shown in FIGS. 14–17, when the doors are open, they lay against the side panels of the desk in an unobtrusive manner that does not interfere with either the function or the appearance of the unit when it is being used as a desk. Hinges 114 and 146 permit the full pivotal movement of these doors all the way around to the side panel of the unit.

The interior of hutch 104 includes a center panel 164 and a plurality of fixed shelves 166 extending between center panel 164 and either side panel 148 of the hutch. These panels could be adjustable in the same manner as the panels of the first embodiment. A pull out file cabinet 168 is mounted in the lower right corner of the interior of the hutch. A hand opening 170 permits the file drawer to be pulled out. The file drawer includes a raised storage compartment 172 on an inner edge of the file cabinet of the file drawer and file storage 174 in a rear portion of the file drawer.

The left hand side of the desk, over the kneehole space, comprises a writing surface or work space 176. This can also serve as a receptacle for a computer monitor 178. A wheeled chair with a fold down back 180 fits in kneehole opening 122, so that the chair can be stored in the desk unit when not in use.

When the doors are opened, this desk unit serves as a fully functioning work area or a computer desk, but when the doors are closed, the fact that the unit is a desk is concealed and the unit has the appearance of a secretary that is used for storage uses that would be more compatible with the decor of a home.

Figure 18:
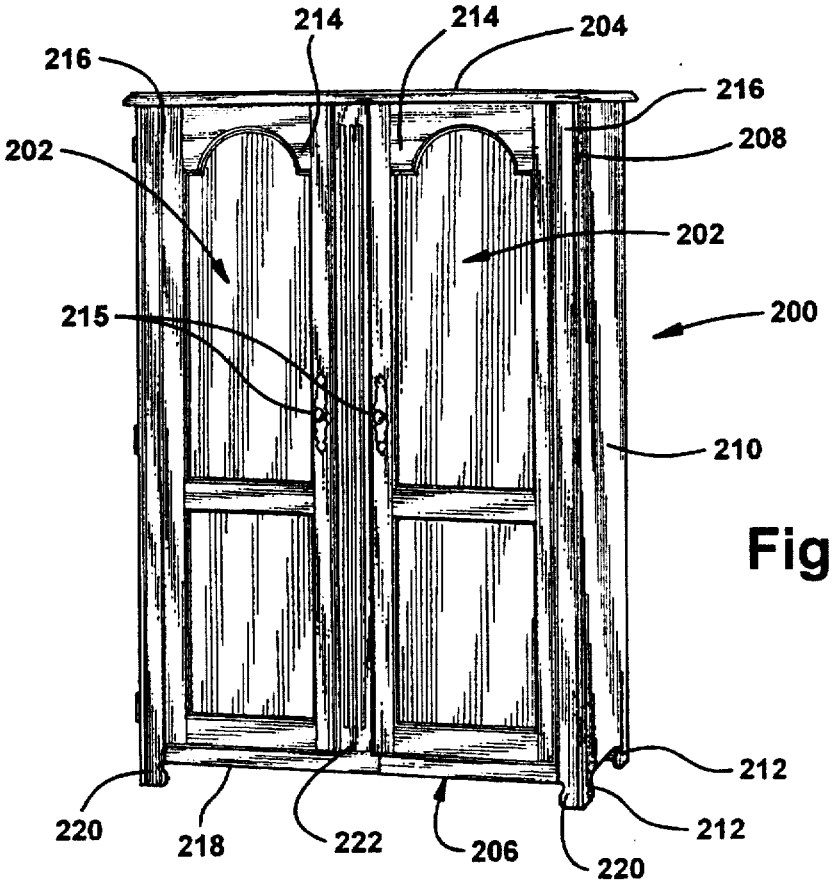
FIG. 18 is a perspective view of a third embodiment of a desk in accordance with the present invention, with cover doors closed.
Figure 19:
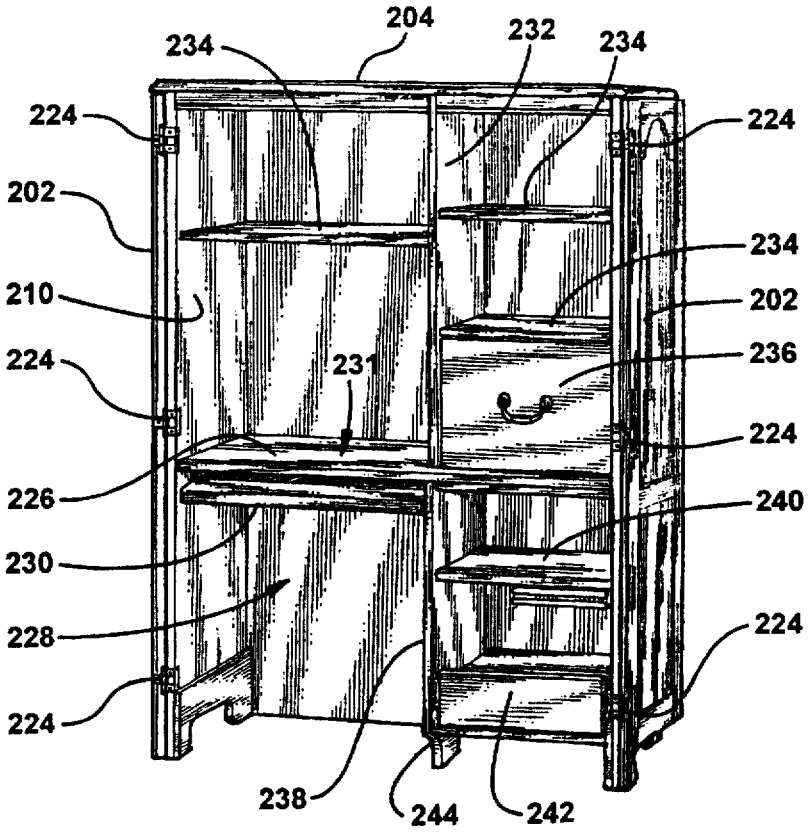
FIG. 19 is a perspective view of the interior of the desk of PIG. 18, with the doors open and folded against the sides of the desk.

Still another embodiment 200 of the present invention is shown in FIGS. 18 and 19. Unit 200 is similar to the other units except that it has a pair of full length doors 202 extending between top 204 and a raised bottom 206 of the unit. Doors 202 are mounted on hinges 208 at the front edges of side panels 210, which also run the full height of the unit. Side panels 210 include legs 212 at the front and rear corners of the side panels.

As in the previous embodiment, doors 202 have a facade that makes it appear as if smaller door panels 214 are hinged on fixed frame comprising vertical side strips 216, and a fixed lower strip 218 that extends between side members 216. Two feet 220 appear to be fixed in position on the bottom of side strips 216. The doors appear to pivot inwardly and latch on a vertical center strip 222 that is fixed in position in the middle of the cabinet. In reality, the vertical side strips 216 and the lower strip 218 and the center strip 222 all constitute part of the moving doors, with center strip 222 constituting a part of the left door in FIG. 18. Thus, when the doors are opened, the entire interior of the cabinet is opened, revealing the desk unit shown in FIG. 19. When doors 202 are opened, they fold against the side panels 210 of the cabinet in an out-of-the-way position. The doors are hinged on hinges 224 at the front side edges of the side panels in a manner similar to the previous embodiments. When the doors are opened by means of door handles 215, the doors fold flat against the sides of the panels.

The interior of the desk unit comprises a desktop writing surface 226 with a kneehole opening 228 positioned below the writing surface. The writing surface can also be used as a location for positioning a computer monitor. A slide out computer tray 230 is mounted under work surface 226. A center vertical support panel 232 is positioned between side panels 210 and supports a number of shelves 234, which may be adjustable in the manner described above. A pull out file cabinet 236 is mounted at the lower right hand corner of the top of the desk. Writing surface 226 is a portion of a panel 231 that extends the full width of the cabinet between the side panels and serves as the desktop for the unit.

A lower central panel member 238 extends downwardly from the underside of the desktop 231 and supports one side of the pull out keyboard tray on the left side and supports a fixed shelf 240 and a pull out printer shelf 242 on the right side of panel 238. As previously, a front lower edge 244 of panel 238 is recessed so that the panel is not readily apparent from the front of the cabinet (as shown in FIG. 18).

This embodiment of the present invention serves much the same function as the previous embodiments, with the exception that the exterior of the cabinet employs two full length doors and a full length cabinet that is not interrupted by an outstanding peripheral edge of a desktop. Thus, while the other embodiments create the impression of two section units or a unit having upper and lower sections connected together, this embodiment Gives the impression of a single cabinet with full length doors, such as an armoir.

While preferred embodiments of the present invention have been described and shown, various changes and modifications may be made in these embodiments without departing from the spirit and scope of the present invention, which is defined in the appended claims.

I claim:

1. A desk having a concealed front and sides comprising a desktop having downwardly extending side panels that enclose opposite sides of the desk below the desktop and provide a support means for supporting the desktop at opposite sides thereof, the side panels leaving a kneehole opening under the desktop between the side panels, the desk further including doors pivotally mounted on front edges of the side panels on opposite sides of the desk, the doors being pivotal between a closed position, wherein the doors cover the entire front of the desk beneath the work surface, and an open position, wherein the kneehole opening is exposed and accessible, the doors folding flat against the side panels of the desk when opened, such that the doors are inconspicuous when opened and do not interfere with the operation of the desk, the doors further including portions at lower edges of the doors adjacent the bottom of the desk that have the appearance of fixed position lower cross panels that extend at least part of the way across the front of the desk, whereas these portions actually open with the doors so as to leave the front of the desk open and unobstructed.

2. A desk having a concealed front and sides comprising a desktop having downwardly extending side panels that enclose opposite sides of the desk below the desktop and provide a support means for supporting the desktop at opposite sides thereof, the side panels leaving a kneehole opening under the desktop between the side panels, the desk further including doom pivotally mounted on front edges of the side panels on opposite sides of the desk, the doors being pivotal between a closed position, wherein the doors cover the entire front of the desk beneath the work surface, and an open position, wherein the kneehole opening is exposed and accessible, the doors folding flat against the side panels of the desk when opened, such that the doors are inconspicuous when opened and do not interfere with the operation of the desk, the doors further including portions at lower edges of the doom adjacent the bottom of the desk that have the appearance of fixed position edge molding that extends across the lower edge of the desk, whereas these portions actually open with the doors and leave the front of the desk open and unobstructed.

3. A desk having a concealed front and sides comprising a desktop having downwardly extending side panels that enclose opposite sides of the desk below the desktop and provide a support means for supporting the desktop at opposite sides thereof, the side panels leaving a kneehole opening under the desktop between the side panels, the desk further including doors pivotally mounted on front edges of the side panels on opposite sides of the desk, the doors being pivotal between a closed position, wherein the doors cover the entire front of the desk beneath the work surface, and an open position, wherein the kneehole opening is exposed and accessible, the doors folding flat against the side panels of the desk when opened, such that the doors are inconspicuous when opened and do not interfere with the operation of the desk, and further comprising a drawer unit mounted on at least one side of the desk between the kneehole opening and a side panel, the drawer unit being supported by an inner panel adjacent the kneehole opening on an inner side of the drawer unit, the inner panel having a bottom edge that is supported on the floor, a front corner of the inner panel being recessed rearwardly from the front of the desk so as to conceal the inner panel and create the impression that the desk is a cabinet supported only at its outer side edges.

4. A desk having a concealed front, comprising:

a desktop;

two opposing desk side panels that extend below said desktop to support said desktop above a floor, each said desk side panel having a front edge that faces the front of the desk, the desk side panels being spaced apart from one another, whereby the desk has a kneehole opening under said desktop and between said desk side panels, to accommodate a user seated at the desk; and two desk doors, whereby a desk door is hingedly attached at said front edge of each said desk side panel, to pivot between a closed position in which said desk doors cover and conceal the said front of the desk, and an open position in which said desk doors fold flat against said desk side panels and said kneehole opening is exposed and accessible, whereby said desk doors are inconspicuous when opened and do not interfere with use of the desk, said desk doors have lower edges that are adapted to have an appearance of fixed position edge molding that extends across a lower edge of the desk, whereas said lower edge actually open with said desk doors and reveal said front of the desk open and unobstructed.

5. A desk having a concealed front, comprising:

a desktop;

two opposing desk side panels that extend below said desktop to support said desktop above a floor, each said desk side panel having a front edge that faces the front of the desk, the desk side panels being spaced apart from one another, whereby the desk has a kneehole opening under said desktop and between said desk side panels, to accommodate a user seated at the desk; and two desk doors, whereby a desk door is hingedly attached at said front edge of each said desk side panel, to pivot between a closed position in which said desk doors cover and conceal the said front of the desk, and an open position in which said desk doors fold flat against said desk side panels and said kneehole opening is exposed and accessible, whereby said desk doors are inconspicuous when opened and do not interfere with use of the desk; and a drawer unit mounted on at least one side of the desk between said kneehole opening and a side panel, said drawer unit being supported by an inner panel adjacent said kneehole opening on an inner side of said drawer unit, said inner panel having a bottom edge that is supported on said floor, a front corner of said inner panel being recessed rearwardly from said front of the desk so as to conceal said inner panel and create the impression that the desk is a cabinet supported only at its outer side edges.

* * * * *

UNITED STATES PATENT AND TRADEMARK OFFICE

CERTIFICATE OF CORRECTION

PATENT NO. :5,678,905

DATED :10/21/97

INVENTOR(S) : Kelley

It is certified that error appears in the above-identified patent and that said Letters Patent is hereby corrected as shown below:

Column 2, line 66:

"PIG." should be --FIG.--;

Column 3, line 57:

"121" should be --12--'

Column 7, Claim 2, line 20:

"doom" should be -- doors--;

Column 7, Claim 2, line 29:

"doom" should be -- doors --.

Signed and Sealed this

Sixth Day of January, 1998

*Attest:*

*Attesting Officer*

BRUCE LEHMAN

*Commissioner of Patents and Trademarks*